United States Patent [19]

Edwards, Jr.

[11] 4,308,433

[45] Dec. 29, 1981

[54] MASTER SWITCH FOR MULTI-SPEED VEHICLES

[75] Inventor: Stanley H. Edwards, Jr., Asheville, N.C.

[73] Assignee: Square D Company, Palatine, Ill.

[21] Appl. No.: 83,035

[22] Filed: Oct. 9, 1979

[51] Int. Cl.[3] ..... H01H 19/04

[52] U.S. Cl. ..... 200/5 R; 200/14; 200/153 LB; 200/307; 338/134

[58] Field of Search ..... 338/134, 135, 164, 172, 338/191, 198, 200; 200/11 R, 5 R, 14, 17 R, 307, 303, 292, 153 LB, 153 L; 334/50, 51, 57, 58

[56] References Cited

U.S. PATENT DOCUMENTS

| | | | |
|---|---|---|---|
| 2,808,515 | 10/1957 | Nestlerode et al. | 334/51 |
| 3,493,696 | 2/1970 | Rothweiler | 200/14 X |
| 3,674,961 | 7/1972 | Wright, Jr. | 200/307 |
| 3,918,022 | 11/1975 | Puerner | 338/134 |

*Primary Examiner*—J. V. Truhe
*Assistant Examiner*—Morris Ginsburg
*Attorney, Agent, or Firm*—Michael J. Femal

[57] ABSTRACT

A selector switch assembly includes modular switch units that are serially-arranged in a housing and are operated by a single rotatable control member that is biased to a first position by a biasing unit. A modular switch unit includes a housing that has an end wall and two opposite sidewalls that each have two recesses at opposite ends which receive planar blade portions of switches to define an enclosure. The control member includes a hollow tube that has a friction member which has cams on the periphery to actuate the switches and also has an opening for frictionally engaging a rotatable adjusting screw on the next modular switch unit. The modular units are sealed into a support and the hollow tube provides access to the adjusting screw outside the support.

17 Claims, 6 Drawing Figures

20
18
14
3.
3.
92
2.
2.
98
99
99
74
96
90
16
230
232
12
230
240
10
242
L
70

20
30
80
82
240
L
70
174
166
164
209
180
182
96
176
74
201
88
98
214
146
147
142
132
140
130
122
120
200
202
16
12
160
144

MASTER SWITCH FOR MULTI-SPEED VEHICLES

TECHNICAL FIELD OF THE INVENTION

The present invention relates generally to multi-position switches and, more particularly, to multi-position switches wherein several circuits are alternately completed and interrupted to control the speed and direction of a vehicle powered through an electric power supply.

BACKGROUND OF PRIOR ART

Rotary-type selector switches have long been used to control the operation of electrically-powered material handling vehicles, such as fork lift trucks and the like. Normally these types of switch assemblies have a plurality of switches therein which are selectively actuated to change the resistance between a power source, such as a battery, and an electrically-operated drive member.

One type of rotary selector switch assembly which has been previously used for control of vehicles of the type referred to above is disclosed in U.S. Pat. No. 3,493,696, which is assigned to the assignee of the present invention. This particular switch assembly consists of a plurality of modular components which each have a switch supported therein and are interconnected to form a plurality of switch units that can be operated utilizing a single rotatable member having cams thereon. While this type of unit has found a remarkable degree of commercial success, manufacturers are constantly striving to improve the efficiency of such a switching system or assembly, reduce its complexity and also, at the same time, reduce the manufacturing cost and assembly time.

One type of control circuit that has been utilized for varying the speed of a vehicle such as a fork lift is what may be commonly referred to as a discrete or step-controlled circuit. This type of circuit incorporates a power source connected in series with a plurality of resistors to a field-winding and an armature of an electrical motor. Parallel switches extend across the resistors and parallel circuits are provided so that reverse current flow can be developed through the armature and, at the same time, selected numbers of resistors can be by-passed to vary the speed of the vehicle.

More recently, a stepless or solid-state control has been developed which includes a variable potential control device as well as a plurality of switches interposed between the field-winding and armature of a battery or power source.

One of the problems encountered in switching systems of this type is to have the capability of providing accurate adjustment of the components for any given vehicle motor.

SUMMARY OF THE INVENTION

According to the present invention, a master selector switch assembly specifically adapted for use in controlling the speed of a material handling implement includes a plurality of components that can be manufactured at a minimum cost, can be assembled in a short period of time, and can be adjusted without the necessity of disassembly of the package. Furthermore, the unit is designed such that the movable components are all covered and sealed from contamination.

More specifically, a modular unit for use with a selector switch assembly includes a rectangular housing that has an end wall with an opening therein and at least a pair of opposed sidewalls extending from opposite parallel edges of the end wall. Each sidewall has a recess or slot adjacent each end thereof and two slots on each of the respective ends of the sidewall are direct towards each other to define an elongated space. The switch assemblies each include a rigid planar blade portion that has a fixed contact thereon and a movable contact with the blade portion being received into one of the plurality of sets of slots in the respective sidewalls to close the space between the sidewalls and define a substantially rectangular housing.

In the specific modular unit illustrated, the unit is specifically designed for having three switches located therein and two of the switches have their respective rigid planar blade portions received into one set of slots while a single switch is located in the other slots with a rigid planar spacer of the same dimension as the planar blade portion is received in juxtaposed relation to the single switch so that a substantially rectangular opening is provided between the sidewalls and the respective blade portions and planar spacer.

The modular unit is specifically designed for use with other substantially identical modular units and also is designed to be actuated by a single actuating member that extends through all of the modular units. In one embodiment of the invention, the switch assembly also has a modular unit on one side which has biasing means therein while a variable control unit or means is located on the opposite side of the modular unit having the plurality of switches therein. A single control member extends through all of the modular units and is aligned with a rotatable adjusting member on the variable control unit with a friction member so that the adjusting member rotates with the actuating member while still accommodating for independent adjustment of the adjusting member with respect to the actuating member.

The frictional member interconnecting the rotatable adjusting member as well as the hollow tube also has cam members formed on the peripheral surface thereof which will automatically actuate the respective switches carried by the one or more modular units.

According to one aspect of the invention, the actuating member is in the form of a hollow tube rectangular in cross-section to define an opening throughout the length thereof. The opening therefore provides access for independent adjustment of the control means by inserting a tool, such as a screwdriver, through the opening into engagement with a slot in the adjusting member.

According to a further aspect of the invention, the entire mechanism may be enclosed and sealed in a support structure which is preferable in the form of a bracket having an opening through which the actuating member extends and a cover which encloses all of the modular units including the biasing means and the variable control member. A unique sealing means may be provided between the rectangular tube and the circular opening defined in the bracket so that a secure seal is provided for the components located within the cover. However, at the same time, the open end of the hollow tubular member allows for access to the rotatable adjusting member at all times without disassembly of any components.

BRIEF DESCRIPTION OF SEVERAL VIEWS OF DRAWINGS

DETAILED DESCRIPTION

Figure 1:
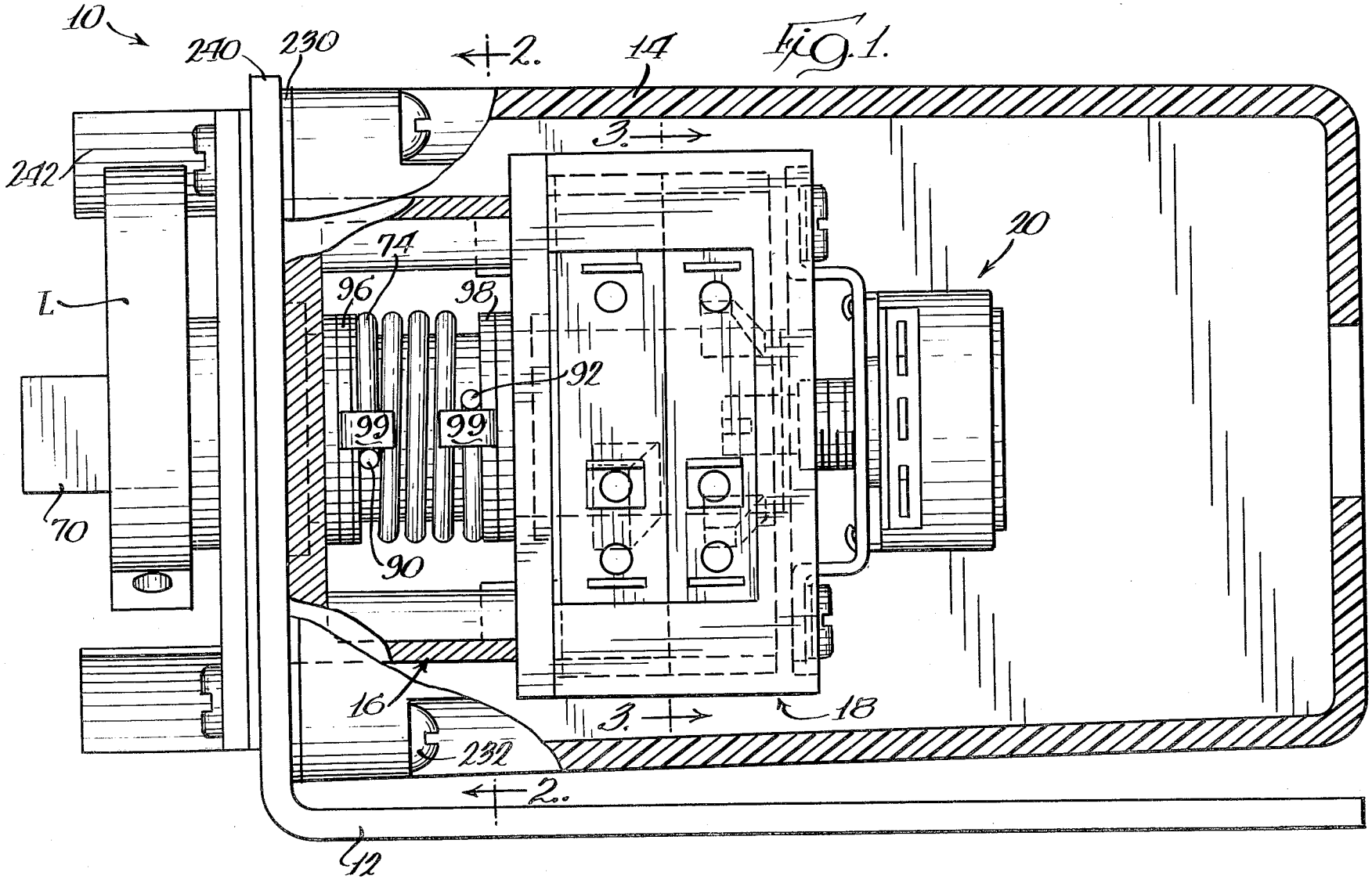
FIG. 1 shows a plan view of the switch assembly enclosed in a support structure with portions thereof broken away for purposes of clarity.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings discloses a master selector switch assembly specifically adapted for use in controlling the speed and direction of movement of a material handling implement, such as a fork lift truck. Switch assembly 10 consists of a biasing modular unit 16, a switching modular unit 18, and a further control modular unit 20 and may include a support or bracket generally designated by reference 12 (to be described later) and a cover 14 which also forms part of the support. The support 12, cover 14 and associated enclosure parts are optional as the basic device may be mounted on and enclosed by the control panel of the vehicle being controlled. As will be explained in more detail, the various modules can readily be assembled into a single unit and may be secured in a fixed position within support structure 12, 14.

Figure 3:
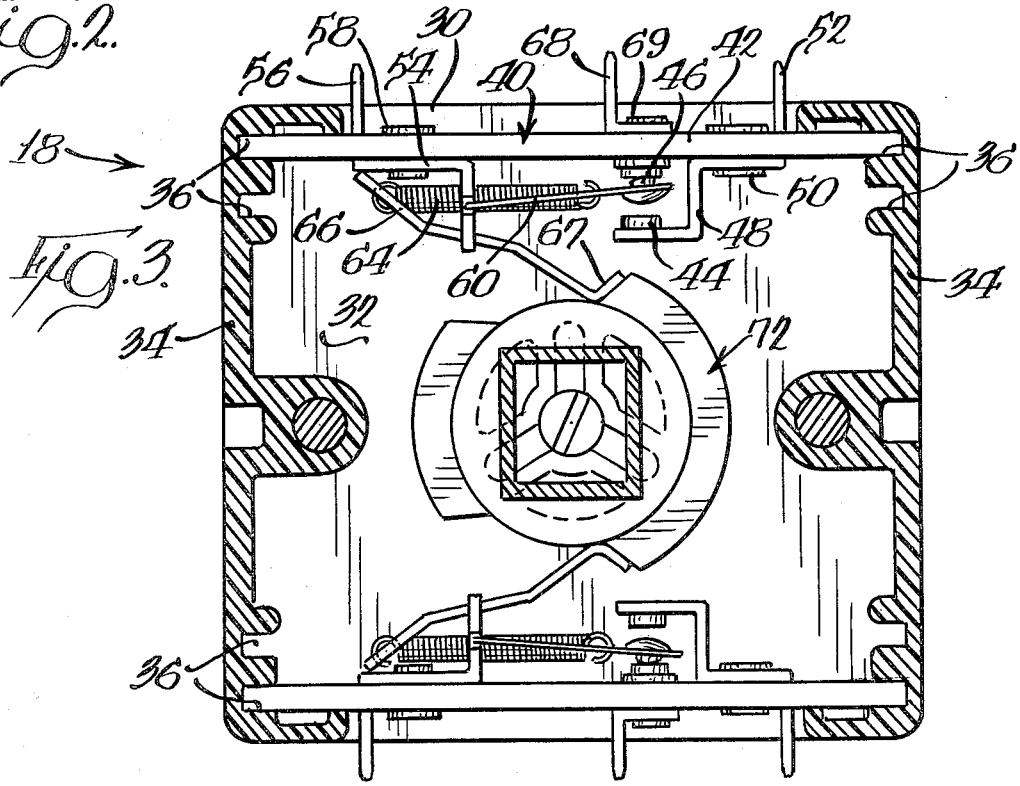
FIG. 3 is a cross-sectional view, as viewed along line 3—3 of FIG. 1.
Figures 4, 5:
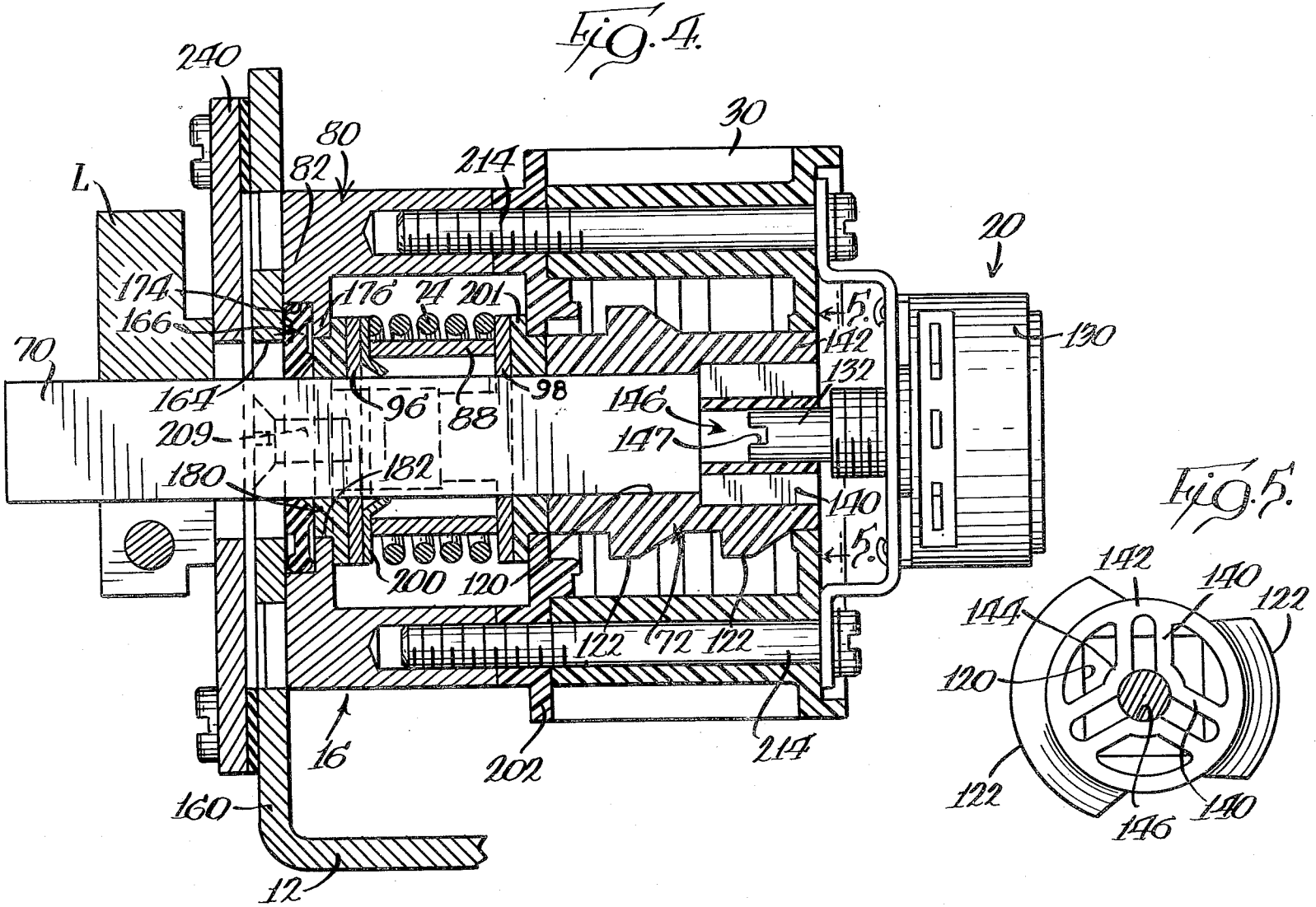
FIG. 4 shows the details of the serially-arranged components within the support, as viewed along line 4—4 of FIG. 2.
FIG. 5 is a fragmentary view, as viewed along line 5—5 of FIG. 4.
Figure 6:
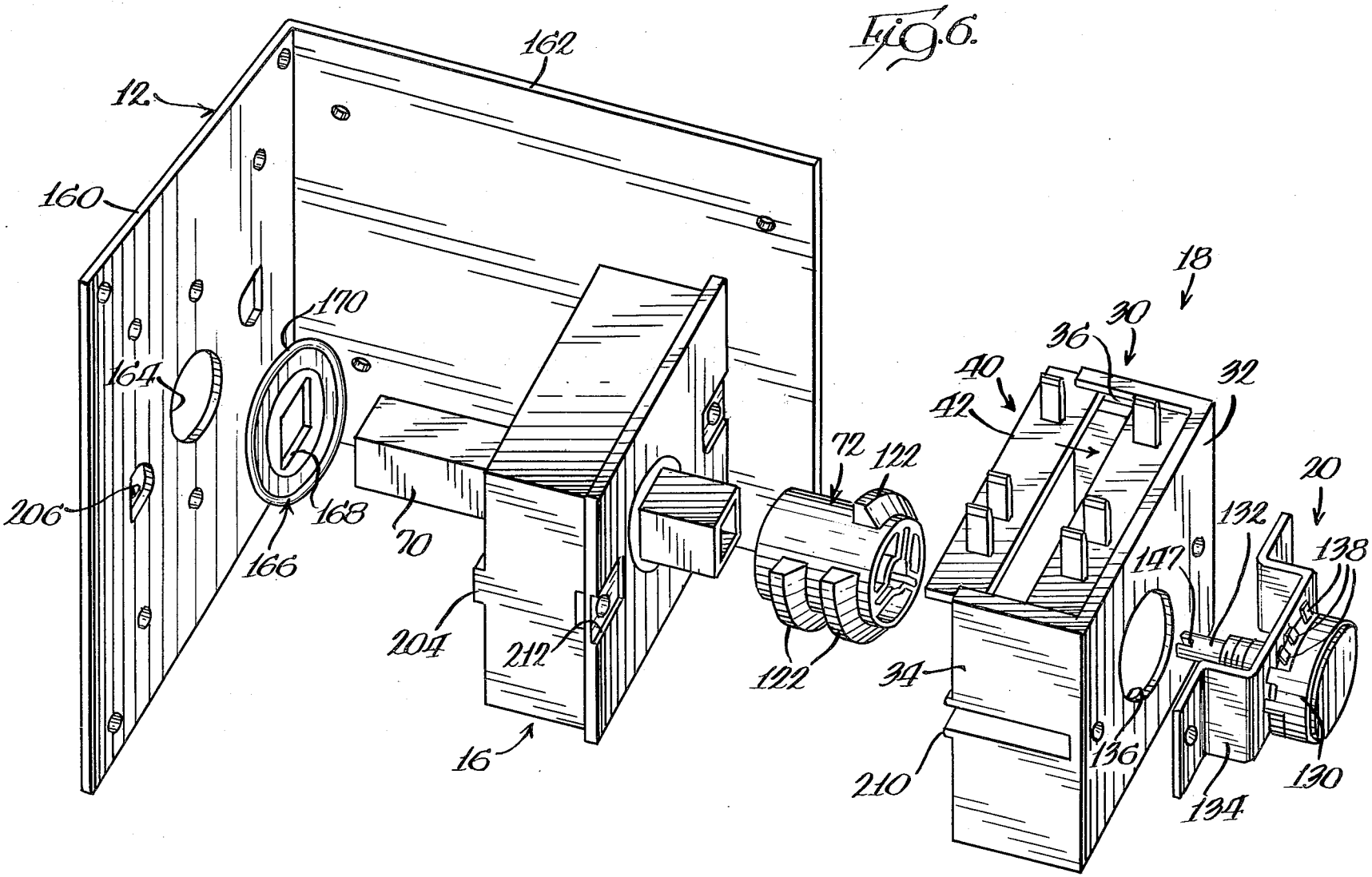
FIG. 6 is an exploded perspective view of the various components before being assembled, the cover being omitted for clarity.

Considering first the principal aspect of the present invention, switch modular unit 18, illustrated in more detail in FIGS. 3, 4 and 6, includes a substantially rectangular housing 30 that has a flat bottom or end wall 32 (FIG. 3) and a pair of opposed sidewalls 34 parallel to each other and extending from opposite edges of rectangular end or bottom wall 32. Each end of each of the sidewalls 34 has one or more recesses 36. Each recess or slot 36 on one wall 34 is aligned with a corresponding recess 36 on the opposite sidewall 34 to define an elongated space.

The respective sets of slots are designed to respectively receive a plurality of switches of unique form that can be installed and removed in a matter of seconds. Each switch 40 is preferably a commercially-available type that can be purchased from Cherry Electrical Products Corporation designated as a Series S-25 Cherry Switch.

More specifically, each switch 40 (FIG. 3) includes a substantially rigid flat planar blade portion 42 which has a fixed contact 44 and a movable contact 46. Fixed contact 44 is secured to a first L-shaped bracket 48 which is secured to blade portion 42 through a rivet 50 and has a prong 52 extending from the opposite side of the blade portion 42. A second L-shaped bracket 54 has a prong 56 and is secured to blade portion 42 by a rivet 58. Second or movable contact 46 is connected to an arm 60 that is pivotally supported at one end on the L-shaped bracket 54 and is normally biased to a first position by a biasing spring 64. An actuating member 66 has an intermediate portion pivoted on L-shaped bracket 54 and one end of spring 64 is secured to a free end of the actuator 66 while the opposite end is connected to an intermediate portion of arm 60. The opposite end of actuator 66 has a camming member 67 defined thereon, which is actuated in a manner to be described later. A third prong 68 is secured by rivet 69 to blade portion 42 and rivet 69 is located in the path of movable contact 46.

With the specific switch assembly 40 of the commercially-available type, the modular unit 18 can readily be assembled merely by insertion of opposite ends of the rigid flat planar blade portion 42 on each switch 40 into the respective recesses 36 defined in sidewalls 34. Thus, the entire assembly can be put together in a matter of seconds and the switch assembly, particularly blade portion 42, will substantially enclose the space between planar sidewalls 34 to provide a substantially-sealed compartment. The arrangement reduces the amount of material needed for making the molded plastic housing and still provide a substantially enclosed compartment open at one end which is sealed in a manner to be described later. Furthermore, prongs 52, 56 and 68 extend outside the housing and are readily accessible for connecting lead wires thereto.

Figure 2:
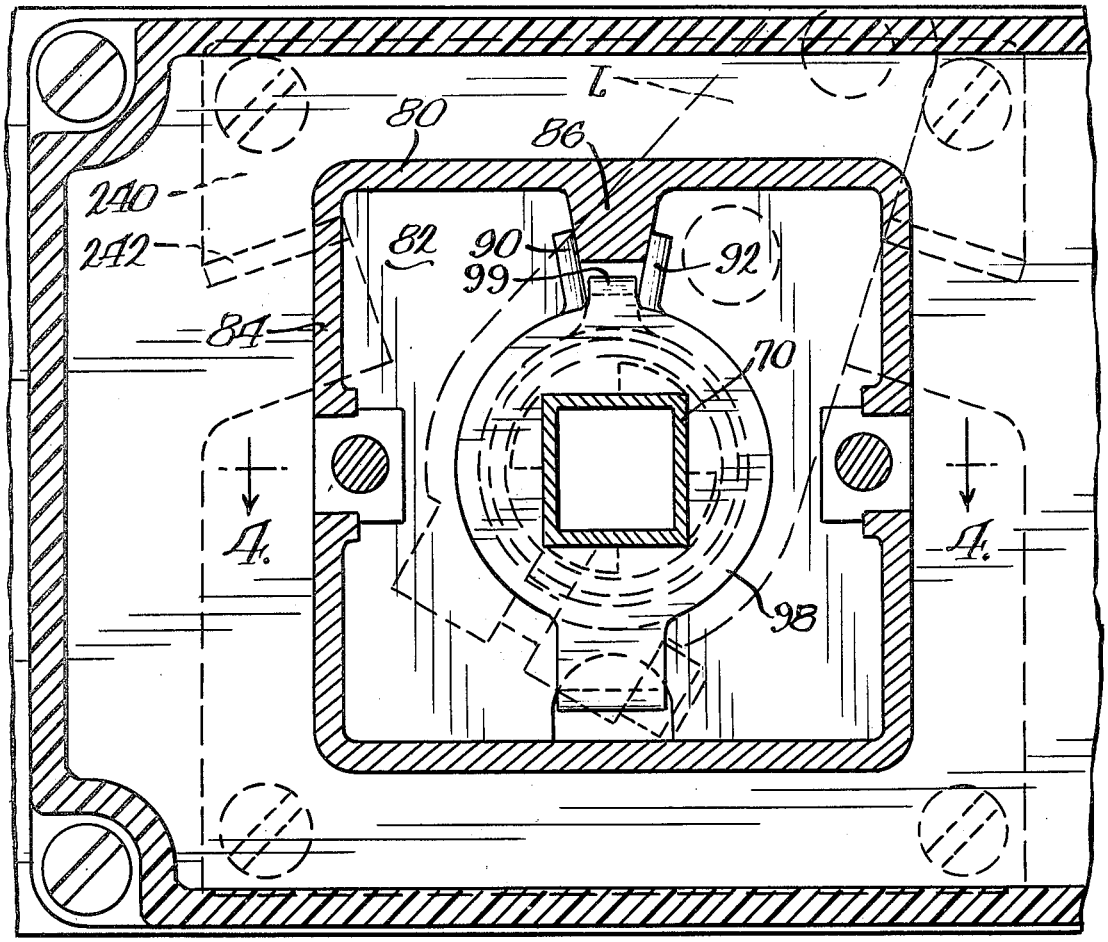
FIG. 2 is a sectional view of the structure, as viewed along line 2—2 of FIG. 1.

The actuating means for actuating the respective switches 42 is disclosed in FIGS. 4 and 6 and consists of a hollow tube 70 that is preferably rectangular in cross-section and has a camming member 72 at one end thereof. Rectangular hollow tube 70 extends through biasing modular unit 16 and biasing unit has a coil spring 74 therein which is adapted to hold the actuating member 70 in a first position. Biasing modular unit 16 includes a substantially rectangular housing 80 that has a bottom wall 82 (FIG. 2) and a peripheral sidewall 84. Peripheral sidewall 84 has an integral inwardly-directed projection 86 which defines a stop means for opposite ends of coil spring 74 that is telescoped over a sleeve 88. As illustrated in FIGS. 1 and 2, the opposite ends 90 and 92 of coil spring 74 respectively cooperate with plates 96 and 98 located on opposite ends of coil spring 74 and have ears 99 interposed between the respective plates and the opposite ends 90 and 92.

The opposite ends 90 and 92 of coil spring 74 are respectively located on opposite sides of projection 86 and therefore the torsional loading of coil spring 74 normally holds the parts in the position illustrated in FIG. 2.

Actuating member or rectangular tube 70 extends through a rectangular opening in one of the plates, such as plate 96 so that the plate rotates with the rectangular tube when the rectangular tube is rotated as will be described later. During such rotation, the end 90 of coil spring 74 will move away from projection 86 and further torsionally load the spring. Upon release of the actuating member, the coil spring will automatically return to the position illustrated in FIG. 2 which defines the first or neutral position for actuating member 70.

The actuating member extends through bracket 12, as will be described later, and may have some type of a control lever like an L extending radially therefrom for a purpose that will be described later.

According to the other aspects of the present invention, actuating means 70 is not only capable of actuating the respective switches 40 carried by one of the modular units 18 but is also capable of simultaneously actuating the variable control means 20 and accommodating adjustment of the variable control means or unit if desired, without removing any of the components from the support structure.

More specifically, camming or friction member 72 (FIGS. 4 and 6) has a substantially rectangular opening 120 adapted to receive the inner end of rectangular tube 70. Frictional member 72 also has a plurality of camming surfaces 122 at least equal in number to the number of switches carried by modular unit 18; in this instance, three such switches being shown in FIG. 6. The camming surfaces 122 are spaced at desired circumferentially-spaced locations around the peripheral surface of frictional member 72 so as to actuate the desired switches at the point of angular rotation for the actuating member, dependent upon the specific design of the unit.

According to one aspect of the invention, the actuating member, including tube 70 and friction member 72, cooperate with the actuating element for the third modular unit 20 which, in the illustrated embodiment, consists of a potentiometer 130 that has a rotatable adjusting member 132 extending from the lower end thereof. Potentiometer 130 is secured to a bracket 134 that is adapted to be secured to the end wall 32 of the modular unit 18 with rotatable adjusting member 132 extending through a circular opening 136 in the end wall 32. Thus, in the assembled condition, rotational adjusting member 132 extends into modular unit 18 through opening 136, as most clearly illustrated in FIG. 4 of the drawings.

Potentiometer 130, which may be considered a manually-adjustable variable control device, also has a plurality of prongs 138 at defined output leads which are connected to suitable components that are being controlled by the selector switch assembly.

Friction member or means 72 has a plurality of inwardly-directed webs 140 (FIG. 5) integral with circular upper end portion 142 and respective adjacent pair of webs 140 are integrally joined at the inner end thereof by arcuate web portions 144. Arcuate web portions 144 cooperate to define a substantially circular opening 146 that receives adjustable member 132. It will be noted in FIGS. 4 and 6 that adjustable member 132 has a slot 147 adapted to receive the conventional end of a flat blade screwdriver.

Before describing the operation of the overall unit, the assembly of the various components illustrated in exploded view in FIG. 6 will be described in further detail.

As illustrated in FIG. 6, bracket 12 is generally L-shaped in cross-section and has a generally horizontal leg 160 and a generally vertical leg 162. Horizontal leg 160 has a substantially circular opening 164 through which actuating member 70 extends and is exposed on the opposite side thereof. A sealing means 166 is interposed between the inner surface of the bracket 12 surrounding opening 164 so that the modular units 16, 18 and 20 are sealed from exposure through opening 164. More specifically, the sealing means 166 has a generally rectangular opening 168 in the center thereof with the inner surface of the opening being designed to provide frictional and sealing engagement with the peripheral surface of the rectangular tube 70. Also, sealing means 166 has a substantially cylindrical periphery 170 that is larger than the opening 164 in bracket 12. Sealing means 166 is received into a circular opening 174 defined in the lower end wall 82 of the modular unit 16 and cooperates with an inwardly-directed flange portion 176 to provide a seal between the lower peripheral wall of modular unit 16 and bracket 12 (specifically leg 160). Additional sealing is provided by a bearing 180 rotatable in a circular opening 182 defined by flange 176 with a portion of the bearing overlying flange 176.

In assembling the various components together as a sealed unit, the rectangular tubular member 70 is initially attached to the spring-biasing modular unit 16, being telescoped over bearing 180, plate 96 and a push-nut 200 that engages the peripheral surface of rectangular tube 70. Sleeve 88, spring 74, plate 98 and a further bearing member 201 are then telescoped over tube 70 and enclosed by a cover 202.

Bottom wall 82 of housing 80 has projections 204 that are received into the openings 206 in bracket 12. Suitable screws, such as screws 209, can then be utilized to secure the housing 80 and rectangular tube or actuating member 70 to the horizontal leg 160 of support 12. Thereafter, the friction member or means 72 can be inserted over the upper free end of the rectangular actuating member 70 and the switch unit 18 can then be inserted over the upper end of friction member 72. To maintain alignment between the units, suitable positioning means 210 and 212 are provided between the cover 202 and the lower edges of sidewalls 34 of unit 18. The respective components can then be secured utilizing elongated screws 214 (FIG. 4) extending through aligned openings in housing 30, cover 202, and wall 84 of biasing unit 16. Thus, the entire assembly is secured to bracket 12 in a permanent fashion and sealing means 166 provides a tight seal between the periphery of opening 164 in bracket 12 and the adjacent surface of housing 80.

Cover 14 is then telescoped over the entire assembly of components and held in sealing engagement with a seal 230 between leg 160 and the open end surface of cover 14 by suitable screws 232. If desired, a plate 240 having ears 242 disposed in the path of movement of lever L may be attached to leg 160 to define two extreme positions for the actuating member. After the unit has been assembled as described, the lever L can be attached to the lower end of tube 70.

In the assembled condition, rotation of actuating member 70 from the first position, illustrated by the phantom lines of lever L in FIG. 2, will rotate friction member 72 and rotatable adjusting member or screw 132 to adjust potentiometer 130 and close the respective switches when the respective cams 122 become aligned with the actuating member 67 illustrated in FIG. 3. Should there by any need for any minor adjustment of the relative position of rotatable adjusting screw 132 and actuating member 70, it is only necessary for the operator to insert a conventional tool, such as a screwdriver, through the open end of hollow member 70 into slot 147 and the frictional engagement between the arcuate web portions 144 can be manually overcome to adjust the relative positions of the two members with respect to each other. All of this can be accomplished without any disassembling of any components, except for a cap which may be inserted into the exposed open end of the rectangular actuating member 70. Thus, the present invention provides a unique arrangement of a sealed unit which need not be disassembled for any of the adjustments which may be necessary to "tune" the selector switch assembly to a particular vehicle.

Many conventional parts are utilized, which can be manufactured at a minimum cost, without the necessity for any complicated machining or grinding. For example, the rectangular tube is a readily-available commercial item that may be cut into appropriate lengths and need not require any special tooling. Also, the friction member 72 can be made of a thermoplastic material and molded at a minimum cost. Since the switches 40 are commercially available items, replacement thereof is again an inexpensive proposition.

Of course, numerous modifications come to mind without departing from the spirit of the invention. For example, while a single switching unit 18 has been disclosed, a plurality of such units could readily be stacked on top of each other and provide numerous switching functions. Also, the number of switches in any given unit 18 could be increased and decreased depending upon the number of switching operations that were desired. Also, the individual unit 20 could be replaced with other types of units, such as a transducer assembly, which could perform the same function utilizing different types of components that are being controlled.

What is claimed:

1. In a selector switch assembly having a support and having a plurality of modular units with an actuating member extending through said units and rotatable on said support, one of said units having biasing means normally maintaining said actuating member in a first position, and another of said modular units having a plurality of switches therein, the improvement of each of said switches having a rigid planar blade portion having a first contact thereon and a movable portion having a second contact normally biased to a position spaced from said first contact, said another modular unit having sets of opposed recesses directed toward each other with a space therebetween, said planar blade portion of said switches being slidably received edgewise into opposed pairs of recesses to be releasably retained therein.

2. A selector switch assembly as defined in claim 1, in which said another modular unit with switches includes a rectangular housing having an end wall with an opening therein and a pair of opposed parallel sidewalls extending from opposed edges of said end wall, said sidewalls each having one of said recesses at each end thereof to define two of said spaces respectively on opposite ends of said sidewalls with said rigid planar blade portions substantially enclosing said spaces.

3. A selector switch assembly as defined in claim 2, further including a variable control means supported on said end wall and having a rotatable adjusting member extending into said opening in said end wall, and in which said actuating member is a hollow tube with frictional means on one end of said hollow tube engaging said adjusting member to cause said adjusting member and tube to rotate as a unit, and in which said hollow tube provides access for accommodating independent adjustment of said variable control means by rotating said adjusting member with respect to said tube.

4. A selector switch assembly as defined in claim 3, in which said one of said modular units has a circular opening in an exposed end wall and in which said hollow tube is rectangular in cross-section and extends through said circular opening, further including sealing means rotatable in said circular opening and sealingly engaging a peripheral rectangular surface of said hollow tube.

5. A selector switch assembly as defined in claim 4, in which said support includes a bracket having an opening therein with said hollow tube extending through said opening and having a lever projecting radially therefrom and a cover secured to said bracket enclosing said modular units, said hollow tube providing access to said rotatable adjusting member while said units are enclosed by said cover.

6. A selector switch assembly as defined in claim 5, further including a plate secured to said bracket and surrounding said tube, said plate having spaced stop means disposed in the path of said lever and defining said first position and an extreme position.

7. A selector switch assembly as defined in claim 1, further including variable control means secured in juxtaposed relation with an exposed surface of said another unit and having a circular adjusting member directed toward said actuating member and in which said actuating member is a hollow tube to provide access to said adjusting member further including a friction member between said hollow tube and said adjusting member normally producing rotation of said tube and said adjusting member as a unit and accommodating independent rotation of said adjusting member with respect to said tube by a tool extending through said tube.

8. A selector switch assembly as defined in claim 7, in which said hollow tube is rectangular in cross-section with said friction member telescoped over said tube and having an opening receiving said circular adjusting member and in which said friction member has integral cams on a peripheral surface for actuating said switches.

9. A selector switch assembly as defined in claim 8, in which said friction member is hollow throughout its length and has integral inwardly-directed webs adjacent a free end of said hollow tube and cooperating to define said opening.

10. A modular unit for use with a selector switch assembly comprising a rectangular housing having an end wall with an opening therein and at least one pair of opposed parallel sidewalls extending from opposed parallel edges of said end wall, each sidewall having an elongated inwardly-directed recess adjacent each end thereof with opposed pairs of recesses on the respective sidewalls defining two sets of slots, a plurality of switches each having a rigid planar blade portion having a fixed contact and a movable contact, said planar blade portions being received in respective sets of slots to substantially close the space between said sidewalls.

11. A modular unit as defined in claim 10, in which there is at least one switch in each set of slots further including at least one rigid planar spacer in at least one set of slots engaging said planar blade portion therein.

12. A modular unit as defined in claim 11, in which there are two switches in the other set of slots with said planar blade portions having adjacent edges in contiguous engagement with each other and a single switch in said one slot with said rigid planar spacer having an edge in contiguous engagement with an adjacent edge of said single switch.

13. A selector switch assembly comprising a housing having a manually-variable control means actuable to produce a control function and including a rotatable adjusting member, an actuating lever including a hollow rectangular tube rotatable in said housing and having an open end extending from said housing, means for frictionally connecting said tube to said adjusting member for rotation as a unit with said hollow tube defining an access opening for gaining access to said adjusting member to produce manual relative rotational movement between said tube and said rotatable adjusting member.

14. A selector switch assembly as defined in claim 13, in which said housing has a plurality of switches therein, each having a fixed contact and a movable contact and said means defining the frictional connection includes integral cams on a peripheral surface thereof at least equal in number to said movable contacts.

15. A selector switch assembly as defined in claim 14, in which said housing is rectangular and has an end wall having an opening with said adjusting member extending through said opening and said control means secured to said end wall and has sidewalls, said housing having a pair of recesses with recesses on respective sidewalls aligned to defined two sets of slots, each switch having a rigid planar blade portion with opposite ends received in said slots to enclose the space between said sidewalls.

16. A selector switch assembly as defined in claim 13, further including a bracket having an opening with said tube extending through said opening and said housing secured to said bracket, a sealing element rotatable with said tube and surrounding said opening in said bracket to provide a seal, and a cover surrounding said housing and secured to said bracket, said open end of said tube being exposed for insertion of a tool to engage said adjusting member while enclosed by said bracket and said cover.

17. A selector switch assembly as defined in claim 16, further including a biasing unit interposed between said housing and said bracket with said tube extending through said biasing unit, said biasing unit cooperating with said tube to define a neutral position and accommodating movement from said neutral position.

* * * * *